United States Patent [19]

Erickson

[11] 4,027,400

[45] June 7, 1977

[54] FLUID REMOVAL IN FOOD PROCESSING, METHOD AND APPARATUS

[75] Inventor: David R. Erickson, Downers Grove, Ill.

[73] Assignee: Swift and Company Limited, Chicago, Ill.

[22] Filed: Jan. 6, 1975

[21] Appl. No.: 538,564

[52] U.S. Cl. ..... 34/17; 34/60; 210/71; 210/401; 426/443

[51] Int. Cl.[2] ..... F26B 7/00

[58] Field of Search ..... 210/68, 71, 387, 388, 210/396, 401, 406; 209/431, 432, 433; 100/110, 118, 121; 198/29, 184; 162/209, 311, 313, 337, 355; 23/273 F; 426/443

[56] References Cited

UNITED STATES PATENTS

| | | | |
|---|---|---|---|
| 617,953 | 1/1899 | Carman | 209/431 |
| 1,111,217 | 9/1914 | Cole | 210/388 X |
| 1,205,117 | 4/1916 | Stamm | 34/95 |
| 1,259,774 | 3/1918 | Peters | 34/95 |
| 1,538,788 | 5/1925 | Fish | 162/355 |
| 2,195,371 | 3/1940 | Moore | 100/118 UX |
| 2,207,278 | 7/1940 | Albrecht | 100/118 |
| 2,209,759 | 7/1940 | Berry | 34/9 |
| 2,419,876 | 4/1947 | Birdseye | 34/60 X |
| 2,575,426 | 11/1951 | Parnell | 34/17 X |
| 2,904,495 | 9/1959 | Ferris | 210/401 |
| 3,070,899 | 1/1963 | Lappin, Jr. | 34/95 |
| 3,262,215 | 7/1966 | Davis et al. | 34/17 |
| 3,613,564 | 10/1971 | Adamski et al. | 100/118 |
| 3,702,297 | 11/1972 | Maksim, Jr. | 210/DIG. 25 |
| 3,703,963 | 11/1972 | Eguchi et al. | 210/401 |
| 3,965,581 | 6/1976 | Candor | 34/164 |

FOREIGN PATENTS OR APPLICATIONS

| | | | |
|---|---|---|---|
| 920,377 | 3/1963 | United Kingdom | 100/118 |

*Primary Examiner*—Theodore A. Granger
*Attorney, Agent, or Firm*—Edward T. McCabe; Charles E. Bouton; Raymond M. Mehler

[57] ABSTRACT

A food processing method and apparatus removes surface and absorbed fluids from individual food items during the commercial processing of continuous supplies or batches thereof. The food items are continuously and simultaneously tumbled and contacted with stream of material having an affinity for either or both of aqueous liquids and oily liquids. A vibration device is associated with an inclined run of the stream of material and accomplishes a tumbling of the individual food items to permit substantially all of their surface area to contact the stream of material. An optional heating member may be positioned in the vicinity of the inclined run to supply heat to the fluid on or within the food pieces. A fluid removal mechanism may be positioned on the apparatus for removing and collecting the fluid from the stream of material.

12 Claims, 4 Drawing Figures

FLUID REMOVAL IN FOOD PROCESSING, METHOD AND APPARATUS

This invention relates to a method and an apparatus for continuously processing food items to remove aqueous and/or oily fluids that have been absorbed into or collected upon the surface of the food items. The food items are tumbled and simultaneously contacted with a stream of absorptive material.

In the commercial processing of continuous supplies or batches of individual food items, such items are often subjected to processing steps, such as washing, deep frying, blanching, cooking and boiling, by which liquids come into contact with such food items. Usually, it is desirable to remove and sometimes also to collect such liquids prior to either further processing or packaging. The liquids themselves, fats and oils, for example, may be relatively valuable so as to warrant their removal and collection. The liquids may leave the food items in an unattractive or undesirable state, such as giving the food items an oily or a soggy appearance and consistency. Fluids, especially aqueous liquids, when present during various food processing steps, cause unproductive expenditures of energy when the liquids, along with the food items, must be subjected to temperature changes which often include phase changes such as those associated with the freezing and boiling of water. Other fluids, especially oily liquids, when present during various commercial food processing steps result in air and water pollution hazards. For example, when the food items are cooked in a commercial apparatus that is vented to the atmosphere, oil droplets may be spewed into the air. Also, when food items are rinsed in order to remove a residue, such as cooking oil, the rinsing liquid will contain substances that can create water pollution problems if not properly treated or disposed of.

Despite these highly desirable reasons for removing fluids at various stages of commercial food processing operations, no method or means has been developed which is effective in removing fluids from food items with the speed and efficiency needed to efficiently achieve advantageous results in large scale food processing.

It is accordingly an object of the present invention to provide an improved method and an apparatus for quickly and efficiently removing fluids that are accumulated on the surface of and absorbed into food items during commercial processing.

Another object is an improved method and a means for salvaging fluids such as fats and oils from commercially processed foods.

Yet a further object of the present invention is to provide an improved fluid removal method and means that is easily adaptable for use in conjunction with a variety of types of equipment that are commercially utilized for continuous or batch processing of food items.

Still another object is an improved method and apparatus for continuous removal and/or collection of fluids during production scale processing of food items in order to conserve energy, to permit reuse of the fluids, and to assist in preventing water and air pollution problems that can occur in commercial food processing.

The method and apparatus of this invention accomplishes the removal of excess fluids from individual food items that are processed continuously in batch or stream fashion by tumbling the individual food items along an inclined, vibrating, conveyed stream of absorbent material as the items are conveyed along with such stream of material, which material is a substance that absorbs, but is resistant to deterioration by, either or both aqueous liquids and oily liquids.

Additional objects, if not set forth specifically herein, will be readily apparent to those skilled in the art from the detailed description of the invention and from the drawings in which.

In accomplishing the method of the present invention, continuous supplies of food products are processed. Such food products contain fluids on the surface thereof and absorbed therein which are removed under the present method. These fluids may be of any kind that are used in the processing of food products. For example, the fluid may be water or other aqueous liquid which remains on the food product after a washing step in the processing of any number of commercially processed food items or after a blanching step during the commercial preparation of frozen vegetables. The fluid may be a fat or an oil, such as that residual cooking oil attendant to the deep frying of food products including French fried potatoes, fish, chicken, or potato chips. The fluid may also be a combination of aqueous liquids and oily liquids, such as that associated with fried and then washed food items.

These continuous supplies of food products having a fluid residue are deposited on a conveyed stream of absorbent material. A preferred material is a web or a belt that is washable and absorbent to both aqueous and oily liquids, yet is resistant to alteration or damage by both aqueous and oily liquids. This preferred material is also strong enough to carry a drive load even when wet or alternatively has a backing which provides such strength. Such preferred materials include textile-like products exhibiting a capillary structure such as those made from cotton fibers, synthetic fibers or other woven or structured products. Also suitable are cellulose containing materials, such as absorbent papers or gauzes. Generally, these latter types of products alone lack the strength to carry a drive load, but when it is required that they do so, for example as in the apparatus of FIG. 1, they may be positioned on top of or backed with a stronger, pliable material, such as a synthetic foam, rubber, cloth, canvas, or other commonly used belting material.

Also desirable for use as the conveyed stream of absorbent material are a number of belt or web substances that are especially suitable for use with food products having substantially only an aqueous liquid residue. Such include belts of plastic foam such as polyurethane or other natural or synthetic organic foams which, although highly absorbent to liquids and especially resilient under fluid removal operations, may exhibit a deterioration thereof upon contact with oily liquids, due to the extraction of plasticizers or other undesirable extractable materials within such foams.

The oil would then be tainted with such plasticizers or other extractable material, perhaps preventing its re-use. Examples are the polyvinyl chloride foams which are suitable for removal of aqueous liquids, but which may exhibit the undesirable effect of having oily liquids extract lower polymers of the polymers of the polyvinyl chloride.

Figure 2:
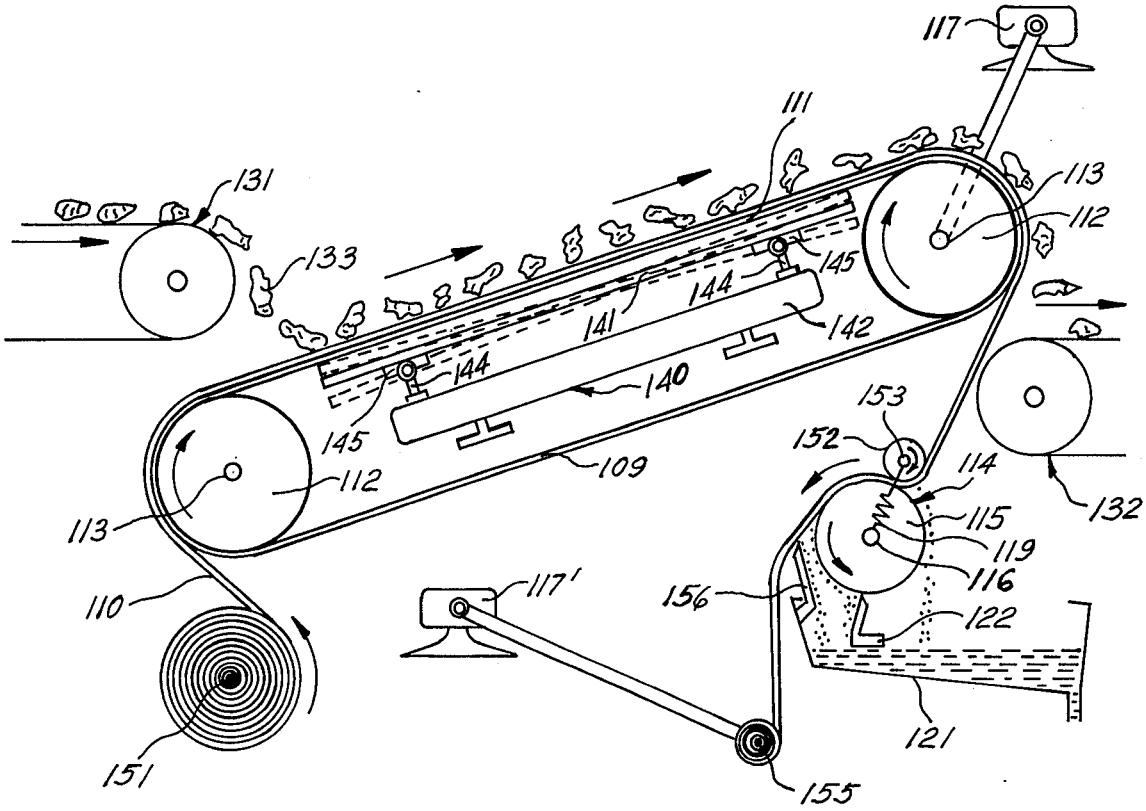
FIG. 2 is an elevation view of an alternate embodiment of the present apparatus.

When there is no need for the conveyed stream of absorbent material to be a belt or web that will carry a drive load, for example as in the apparatus of FIG. 2, same need not be especially strong or resilient. The material may be either disposable or washable. Such materials include relatively thin absorbent papers and gauzes or other lightly structured materials that have no underlayer or backing.

The conveyed stream of absorbent material is not limited to being in the form of a belt or a web; for example, same may be in the form of absorbent granules or powders that are conveyed along the inclined run together with the supply of food items. Substantially concurrent with conveying the food products along the stream of absorbent material, the food products are randomly tumbled such that, on an overall basis, every major surface of each food product is brought into contact with the stream of absorbent material. The tumbling is effected by vibrating the stream of absorbent material along an inclined run. Once such tumbling is completed, the food products, with the fluids removed therefrom, are transferred from contact with the stream of absorbent material for further processing or packaging.

As an optional further step, the stream of absorbent material that had just been in contact with said food products is subjected to a step for removal of the fluids deposited thereon and absorbed thereinto. This step includes either compression of the material, or passing air or some other gas therethrough, or any combination thereof. The fluid is collected and either re-used, treated, or disposed of. For example, if a fluid is oil used in deep frying, the collected oil can usually be returned to the cooking vat, perhaps after filtering or some other purifying step. Should the fluid have both aqueous and oily components, such components can be further processed for separation thereof prior to re-use or disposal.

An optional feature of the present method can be carried on simultaneously with said tumbling and absorbent material contacting step. Heat is provided to assist in keeping the oily liquids in a flowable state to promote their settling upon or absorption into the stream of absorbent material and/or to accomplish some evaporation and hence removal of aqueous liquids or other fluids from the food products. Preferably, such heat is provided by radiant heating means positioned above the inclined run. Also within the scope of this invention is a heat source that is of the convective type.

Figure 1:
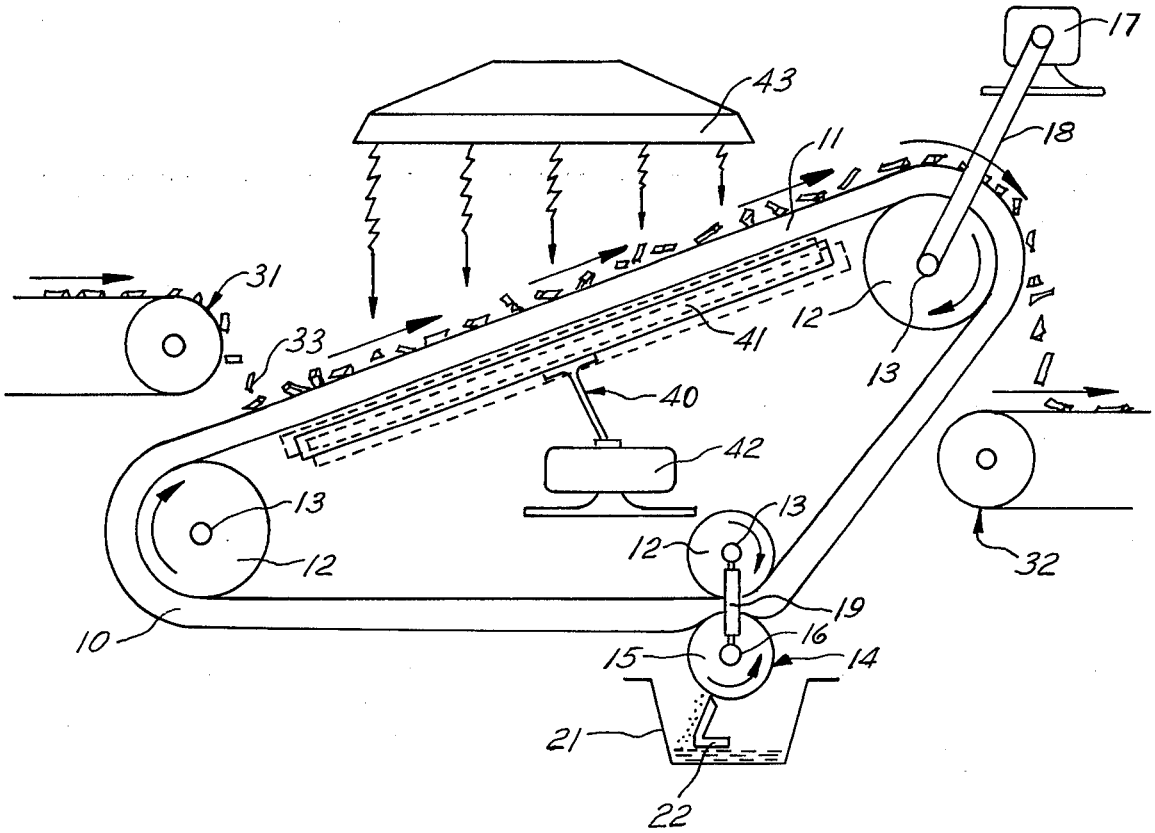
FIG. 1 is an elevation view of a preferred embodiment of the present apparatus.

The preferred embodiment of the present apparatus is depicted in FIG. 1, wherein the conveyed stream of absorbent material is an endless absorbent belt member 10, capable of carrying a drive load and having an inclined run 11. Belt member 10 is positioned along a plurality of rolls 12, which are rotatable about roll axles 13. Located along the path of and in direct compressive contact with belt member 10 is at least one fluid removal means, generally indicated by reference numeral 14, including a squeeze roller member 15 rotatably mounted on a roller axle 16. These structures are arranged such that the belt member 10 is capable of traversing a path along rolls 12, said path including inclined run 11.

At least one roll 12 is rotabably driven by a drive means 17, roll 12 being in communication with drive means 17 by a chain or drive belt 18. The remaining rolls 12 can be either freely rotatable along respective roll axles 13 or can be driven synchronously with the other driven roll. Additional drive means can be provided for this purpose, but preferably any roll 12 which are driven are so driven by the single drive means 17.

Squeeze roller member 15 is mounted so as to apply a compressive force upon the outer surface of the belt member 10 as it comes into contact therewith. The compressive force can be supplied by any suitable means, such as by a resilient member, for example, a spring or an hydraulic arm 19. The squeeze roller member 15 can be rigid or can itself be resilient to assist in the squeezing or compressing of belt member 10. Through the combined operation of squeeze roller member 15, hydraulic member 19, and the roll 12 associated therewith, fluids which are present on or absorbed into belt member 10 are removed therefrom. Some of this fluid immediately falls into vat 21. The rest of the fluid is transferred onto squeeze roller member 15 and is subsequently removed by roller scraper member 22 for collection in vat 21.

At one end of the preferred apparatus and positioned above the endless belt member 10 is a food product supply means, generally indicated by reference numeral 31, which may be in the form of a conveyor system, chute, or the like. This supply means 31 deposits, preferably in a continuous supply, a plurality of food products 33 onto the absorbent endless belt member 10 near the lowest portion of the inclined run 11. At the opposite end of the apparatus and positioned below the belt member 10 is a food product transfer means, generally indicated by reference numeral 32, which may also take the form of a conveyor system, chute, or the like. The transfer means 32 receives the stream of food products 33 as they tumble off belt member 10 near the highest portion of the inclined run 11. Accordingly, the food products 33 move in a substantially continuous stream from one station of the food processing apparatus or one piece of food processing equipment (not shown) by means of food product supply means 31 onto belt member 10, then continue to move up inclined run 11, and thereafter continue along food product transfer means 32 to provide a stream of food products to a later station of a food processing apparatus or another piece of food processing equipment (not shown).

Positioned immediately below the belt member 10 and along substantially all of its inclined run 11 is a vibration means, generally indicated by reference numeral 40, which contacts said inclined run 11 to impart vibrations thereto, which effects a tumbling of the food products 33. While such tumbling is, of course, of a random nature, it changes the orientation of such food products 33 to extent that, on the average, all major surfaces of each food product 33 contact the surface of the inclined run 11. The vibration means 40 may be of any variety of structures. The structure depicted in FIG. 1 is that of a bar member 41 which oscillates through the action of vibrator member 42. Preferably, this oscillation is a combination of movements that are back and forth, side-to-side, and substantially up and down.

Included in the preferred embodiment as depicted in FIG. 1, but not essential to the present invention, is a heating means 43 which is located above and along a majority of the length of the inclined run 11 of the belt member 10. Heating means 43, which may be of a radiant, convective, or other type, is for raising or maintaining the temperature of the outer surfaces of food products 33.

An alternate embodiment of the apparatus is shown in FIG. 2. In this embodiment, an endless belt member 109 is arranged for rotation around at least two rolls 112 each of which are rotatable along roll axle 113. The endless belt member 109 contrary to absorbent endless member 10 of the preferred embodiment does not have to be, and preferably is not, absorbent. Endless belt member 109 includes an inclined run 111 therealong.

In this alternate embodiment, the conveyed stream of absorbent material is a continuous web 110 of absorbent material. The continuous web 110, which need not be capable of carrying a drive load, begins with a clean, dry supply of absorbent material, preferably provided in roll form on a web supply shaft 151. The web 110 contacts the outer surface of endless belt member 109 ahead of the lowest portion of the inclined run 111 and continues along said inclined run 111, moving substantially along with endless belt member 109. The web 110 terminates its contact with the endless belt member 109 shortly after member 109 passes beyond inclined run 111, after which is passes through a fluid removal means indicated generally by numeral 114. The means 114 consists of at least two squeeze roller members 115, 152 rotatably mounted respectively upon roller axles 116, 153. Squeeze roller members 115 and 152 are resiliently joined by a resilient member such as an hydraulic arm or a spring 119.

As the continuous web 110 passes through means 114, most of any fluid that had been accumulated thereon or therein is squeezed therefrom. Some of said fluid then drops into collecting pan 121. The remaining fluid is carried along the surface of, and preferably absorbed into squeeze roller member 115. Although not an essential feature of this invention, it is preferred that member 115 be made of compressible, resilient, absorptive material to facilitate the transfer of fluid from the continuous web 110 to member 115. Some of the remaining fluid then flows off member 115 into collecting pan 121, which process is aided by roller scraper member 122. As an additional, optional feature, there may be provided a web scraper member 156 to remove some residual fluid from the web 110 for further deposit into collecting pan 121. The thus substantially cleaned and dried web 110 is collected upon a web accumulation shaft 155. Preferably, shaft 155 is in driving communication with a drive means 117′, which may be an electric motor or the like, preferably capable of providing a variable speed friction drive.

It is within the scope of this embodiment for the web 110 to be re-used after it has passed through means 114 and optional web scraper member 156. If necessary, such reuse can be carried on after permitting the squeezed web to further dry out. It is also within the scope of this invention for the continuous web to be endless, whereupon web supply shaft 151 and web accumulation shaft 155 are omitted and such endless web is permitted to traverse an endless path on the order of that of the endless belt member 10 of the preferred embodiment depicted in FIG. 1. It is further within the scope of this embodiment that a stream of loose materials, such as granules or the like, (not shown) be substituted for or used in conjunction with continuous web 110.

Continuing further with the alternate embodiment depicted in FIG. 2, a generally continuous stream of food products 133 is deposited upon that portion of continuous web 110 which is moving along inclined run 111 of endless belt member 109, such food products 133 being deposited from a food product supply means, generally indicated by reference numeral 131. Endless belt member 109 is rotated through the operation of a drive means 117 which is connected to at least one roll axle 113. Such stream of food products is tumbled through the action of a vibration means indicated generally by reference numeral 140.

The vibration means 140 includes a bar member 141 connected to a vibrator member 142 by connecting rods 144 to impart a vibrating motion to inclined run 111 and consequently to continuous web 110 as it passes along inclined run 111. Almost any type of vibrator mechanism may be included within vibrator member 142; it may be for example cam or hydraulically operated, and connecting rods 144 may be rigidly or pivotally connected to bar member 141. In the particular arrangement depicted in FIG. 2, connecting rods 144 move up and down in a complimentary manner so as to impart a see-saw motion to bar member 141 and also simultaneously to impart a side-to-side motion thereto, with bar member 141 and connecting rods 144 being rotatably attached by suitable means such as ball-joints 145. Also within the scope of this invention is a vibration means 140 that imparts a circular and/or up-and-down vibratory motion to one or more connecting rods and bar members. Whatever structure is utilized, the vibration effects a tumbling of food products 133 after which they drop onto food product transfer means, generally indicated by reference numeral 132, which then passes the food products 133 from which fluid has been removed on for further processing or packaging.

Figure 3:
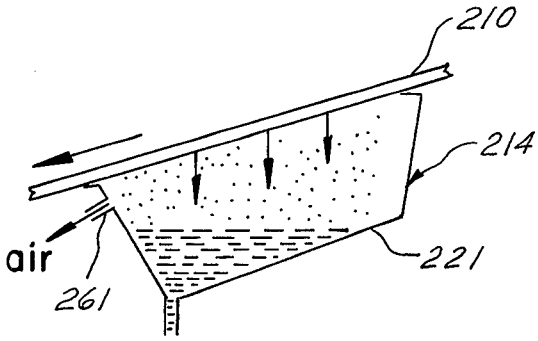
FIG. 3 is a partial view of a further alternate apparatus for fluid removal used in conjunction with either embodiment of FIGS. 1 and 2.

FIG. 3 shows an alternate fluid removal means, generally indicated by reference numeral 214. Means 214 is located along absorbent belt or web member 210 at a position analogous to that of means 14 along endless belt member 10 in FIG. 1 and to that of means 114 along continuous web 110 in FIG. 2. Means 214 includes a collecting pan 221 that butts up against one surface of absorbent member 210 as it passes above means 214. A vacuum pump (not shown) is in communication with one or more conduits 261 in pan 221 to draw air from pan 221 to thereby drop the air pressure within pan 221, resulting in a passage of air from atmosphere through member 210, which passage removes the fluid from member 210 for deposit within pan 221.

Figure 4:
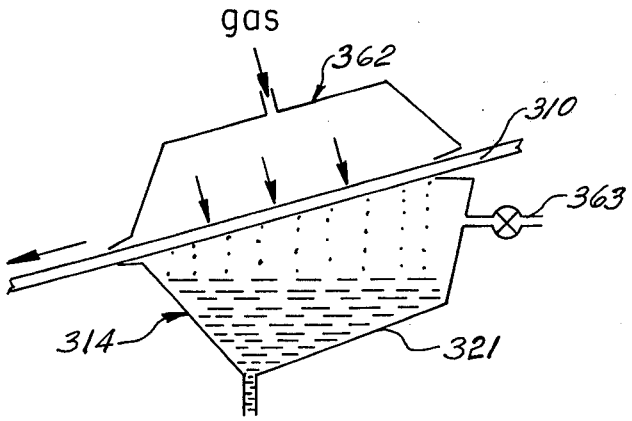
FIG. 4 is a partial view of a further alternate apparatus for fluid removal used in conjunction with either embodiment of FIGS. 1 and 2.

FIG. 4 shows a further alternate fluid removal means, generally indicated by reference numeral 314. Means 314 is located along absorbent belt or web member 310 at a position analogous to that of means 14, 114 and 214. Means 314 includes a means, generally indicated by reference numeral 362, for directing air or other gas at greater than atmospheric pressure along a section of absorbent member 310. This pressurized air or other gas passes through member 310, thereby removing the fluid from member 310, which fluid is deposited within a pan 321. Pan 321 includes a gas escape tube 363, the operation of which prevents gas pressure buildup within pan 321.

The following examples are set forth as illustrative embodiments of the method and are not to be taken in any manner as limiting the scope of the invention which is defined by the appended claims.

EXAMPLE I

Potatoes were cut as elongate items having a substantially square cross-section having a side length of about ½ (about 1.27 cm.) Equal weight batches of such potatoes were deep fried at a temperature of about 360° to 380° F. (about 182° to 193° C.), after which time one batch was placed in a basket and shaken three times and allowed to drain for about 30 seconds. The finished product was then found to weigh 224.5 grams. One of the other baches of potatoes was removed from the same hot oil and tumbled for about 20 seconds on a polyurethane foam in accordance with the present method. These were then weighed, the weight being 219.5 grams, or 5 grams less than that of the shaken and drained French fried potatoes, indicating that the French fries prepared in accordance with the present method succeeded in removing about 2.3% more fat from the finished product than that removed by prior art methods.

EXAMPLE II

The steps taken in Example I were repeated, except this time the batches of raw, elongated potato pieces had a square cross-section ¼ inch (approximately 0.64 cm.) on a side. In this example, the shaken and drained French fried potatoes weighed 163.0 grams, whereas those processed in accordance wih the present method weighed 154.0 grams, a difference of 9.0 grams, indicating that the present method removed about 5.8% more fat from the finished product than did the prior art sample. Also, in both Example I and II the French fried potatoes prepared in accordance with the present invention had an appearance that was drier than that of the products prepared by prior art techniques.

Obviously, many modifications and variations of the invention as hereinbefore set forth may be made without departing from the spirit and scope thereof, and only such limitations should be imposed as are indicated in the following claims.

I claim:

1. An improved method for removing fluid from commercially processed food items, comprising the steps of: maintaining a substantially continuous stream of absorbent material along an inclined run; supplying food items having a fluid residue at a location above the lower portion of said inclined run; passing said food items along said inclined run; mechanically vibrating said inclined run from below; radiantly heating said food items from above to promote flowability of said fluid residue while simultaneously vibrationally tumbling said food items and contacting substantially the entire surface thereof with said stream of absorbent material; transmitting the fluid residue of increased flowability from said food items to the absorbent material; thereafter transferring said food items to a location below the upper portion of said inclined run; and removing said fluid from the absorbent material.

2. The method of claim 1, wherein said fluid is an oily liquid and said absorbent material is selected from the group consisting of cotton fiber, synthetic fiber, natural or synthetic foams, soft canvas, paper, and gauze.

3. The method of claim 1, wherein said fluid is an aqueous liquid and said absorbent material is selected from the group consisting of cotton fiber, synthetic fiber, soft canvas, paper, gauze, polyurethane foam, polyvinyl chloride foam and other natural or synthetic foams.

4. The method of claim 1, wherein said fluid includes both an oily liquid and an aqueous liquid and said absorbent material is selected from the group consisting of cotton fiber, synthetic fiber, soft canvas, paper, gauze, polyurethane foam, polyvinyl chloride foam and other natural or synthetic foams.

5. An apparatus for removing fluid from commercially processed foods, comprising, in combination, an inclined run, a means for conveying a substantially continuous stream of absorbent material through the inclined run, a means for supplying food items having a fluid residue, said food item supplying means being located above the lower portion of said inclined run, an inclined mechanical vibration means in communication with the underside of said inclined run for vibrating said inclined run to thereby tumble said food items, a fluid flowability promoting means positioned above said inclined run, said fluid flowability promoting means including a radiant heating means for heating and increasing the flowability of said fluid residue, the inclined vibration means being for contacting substantially all of the service area of said food items with the absorbent material and for transmitting said fluid residue of increased flowability from the food onto the absorbent material, a transfer means for receiving the said food items after their having been tumbled along said inclined run, said transfer means being located below the upper portion of said inclined run, and fluid removal means for removing said fluid from the absorbent material.

6. The apparatus of claim 5, wherein said fluid removal means includes a plurality of rotatably mounted roller members resiliently connected to each other by a resilient member.

7. The apparatus of claim 6, wherein one of said roller members is contacted by a roller scraper member for removing liquid from said roller member.

8. The apparatus of claim 5, wherein said fluid removal means includes means for passing air or other gas through said conveyed material to remove fluid therefrom.

9. The apparatus of claim 5, wherein said stream of absorbent material is an absorbent endless belt positioned along a plurality of rotatably mounted rolls, at least one of which is driven by a drive means for rotating such roll.

10. The apparatus of claim 9, wherein said absorbent endless belt is a material selected from the group consisting of cotton fibers, synthetic fibers, soft canvas, paper, gauze, polyurethane foam, polyvinyl chloride foam, and other natural or synthetic foams.

11. The apparatus of claim 5, wherein said stream of absorbent material is a continuous web that contacts the outer surface of an endless belt substantially throughout the extent of said inclined run, said endless belt being positioned along a plurality of rotatably mounted rolls, at least one of which is driven by a drive means for rotating such roll.

12. The apparatus of claim 11, wherein said continuous web is a material selected from the group consisting of cotton fibers, synthetic fibers, soft canvas, paper, gauze, polyurethane foam, polyvinyl chloride foam and other natural or synthetic foams.

* * * * *

UNITED STATES PATENT OFFICE

CERTIFICATE OF CORRECTION

Patent No. 4,027,400 Dated June 7, 1977

Inventor(s) David R. Erickson

It is certified that error appears in the above-identified patent and that said Letters Patent are hereby corrected as shown below:

The patent should show on its face that it is assigned to Swift & Company of Chicago, Illinois.

Signed and Sealed this

*Eleventh* Day of *October 1977*

[SEAL]

*Attest:*

RUTH C. MASON
*Attesting Officer*

LUTRELLE F. PARKER
*Acting Commissioner of Patents and Trademarks*